US005913697A

United States Patent [19]

Myer et al.

[11] Patent Number: 5,913,697

[45] **Date of Patent: *Jun. 22, 1999**

[54] ELECTRICAL CONNECTOR HAVING A SECONDARY LOCK

[75] Inventors: John Mark Myer, Millersville; John Raymond Shuey, Mechanicsburg; Forrest Irving Kinsey, Jr., Harrisburg, all of Pa.

[73] Assignee: The Whitaker Corporation, Wilmington, Del.

[21] Appl. No.: 08/979,467

[22] Filed: Nov. 26, 1997

Related U.S. Application Data

[60] Provisional application No. 60/032,373, Dec. 10, 1996.

[51] Int. Cl.[6] ..... H01R 13/40

[52] U.S. Cl. ..... 439/595

[58] Field of Search ..... 439/595

[56] References Cited

U.S. PATENT DOCUMENTS

| | | | |
|---|---|---|---|
| 4,973,268 | 11/1990 | Smith et al. | 439/595 |
| 5,108,310 | 4/1992 | Sawada et al. | 439/595 |
| 5,127,854 | 7/1992 | Fujitani et al. | 439/595 |
| 5,176,537 | 1/1993 | Samejima et al. | 439/595 |
| 5,186,662 | 2/1993 | Yuasa et al. | 439/752 |
| 5,256,084 | 10/1993 | Kodama | 439/595 |
| 5,484,223 | 1/1996 | Saito | 403/329 |
| 5,529,515 | 6/1996 | Ohtaka et al. | 439/595 |
| 5,575,683 | 11/1996 | Saito et al. | 439/595 |
| 5,713,761 | 2/1998 | Okayasu | 439/595 |
| 5,730,626 | 3/1998 | Tomita et al. | 439/595 |
| 5,743,762 | 4/1998 | Takahashi | 439/595 |

*Primary Examiner*—Neil Abrams
*Assistant Examiner*—T. C. Patel
*Attorney, Agent, or Firm*—M. K. Vanatten

[57] ABSTRACT

The invention comprises an electrical connector having a body with an inner member with contact receiving passages therein. The contact receiving passages have latching arms which can be deflected into channels. The inner member has latching grooves disposed along sides thereof. A secondary locking member has latching arms to be received along the sides of the inner member within the latching grooves. The secondary locking member has cross arms. The secondary locking member has a first latched position wherein contacts can be received within the contact receiving passages and a second latched position wherein the cross arms are received within the channels thereby locking the contacts therein.

18 Claims, 5 Drawing Sheets

ELECTRICAL CONNECTOR HAVING A SECONDARY LOCK

This application claims the benefit of U.S. Provisional Application No. 60/032,373, Filed Dec. 10, 1996.

FIELD OF THE INVENTION

The present invention is directed to an electrical connector having a secondary lock.

BACKGROUND OF THE INVENTION

It is known to provide a secondary lock for electrical connectors. One form of secondary lock is used in an electrical connector having deflectable latching arms. When the contacts are inserted into such connectors, the latching arms deflect to allow passage of the contacts. When the contacts are fully inserted, the latching arms resile into their initial position and latch behind a shoulder or some other surface on the contact thereby securing the contact within the connector. A secondary lock is then inserted into the connector. The secondary lock has surfaces that are received into spaces proximate to the latching arms. When the secondary lock is in place, the surfaces prevent the latching arms from deflecting and thereby secure the contacts within the connector. A further feature of the secondary lock is that the secondary lock can not be inserted into the connector unless all of the latching arms are in their resting, nondeflected position. Therefore, if one of the contacts is not properly positioned, the latching arm will be deflected and the secondary lock will be prevented from being inserted into the connector.

One of the problems that exists in the prior art connectors with secondary locks is the provision of a good seal between the connector and a mating connector because of the latching surfaces necessary on the connector. An additional problem that exists is the need for precisely formed lead-in surfaces for the contacts in the mating connector.

SUMMARY OF THE INVENTION

The invention comprises an electrical connector having a body with an inner member with contact receiving passages therein. The contact receiving passages have latching arms which can be deflected into channels. The inner member has latching grooves disposed along sides thereof. A secondary locking member has latching arms to be received along the sides of the inner member within the latching grooves. The secondary locking member has cross arms. The secondary locking member has a first latched position wherein contacts can be received within the contact receiving passages and a second latched position wherein the cross arms are received within the channels thereby locking the contacts therein.

The invention further comprises an electrical connector having a body with an inner member with contact receiving passages therein. The contact receiving passages have latching arms which can be deflected into channels. The inner member has latching grooves disposed along sides thereof. A seal is received around the inner member. A secondary locking member has latching arms to be received along the sides of the inner member within the latching grooves. The secondary locking member has cross arms. The secondary locking member has a first latched position wherein contacts can be received within the contact receiving passages and a second latched position wherein the cross arms are received within the channels thereby locking the contacts therein. The secondary locking member engages and secures the seal when the secondary locking member is in the second latched position.

BRIEF DESCRIPTION OF THE DRAWINGS

An embodiment of the present invention will now be described by way of example with reference to the accompanying drawings, in which.

DETAILED DESCRIPTION OF THE INVENTION

Figure 1:
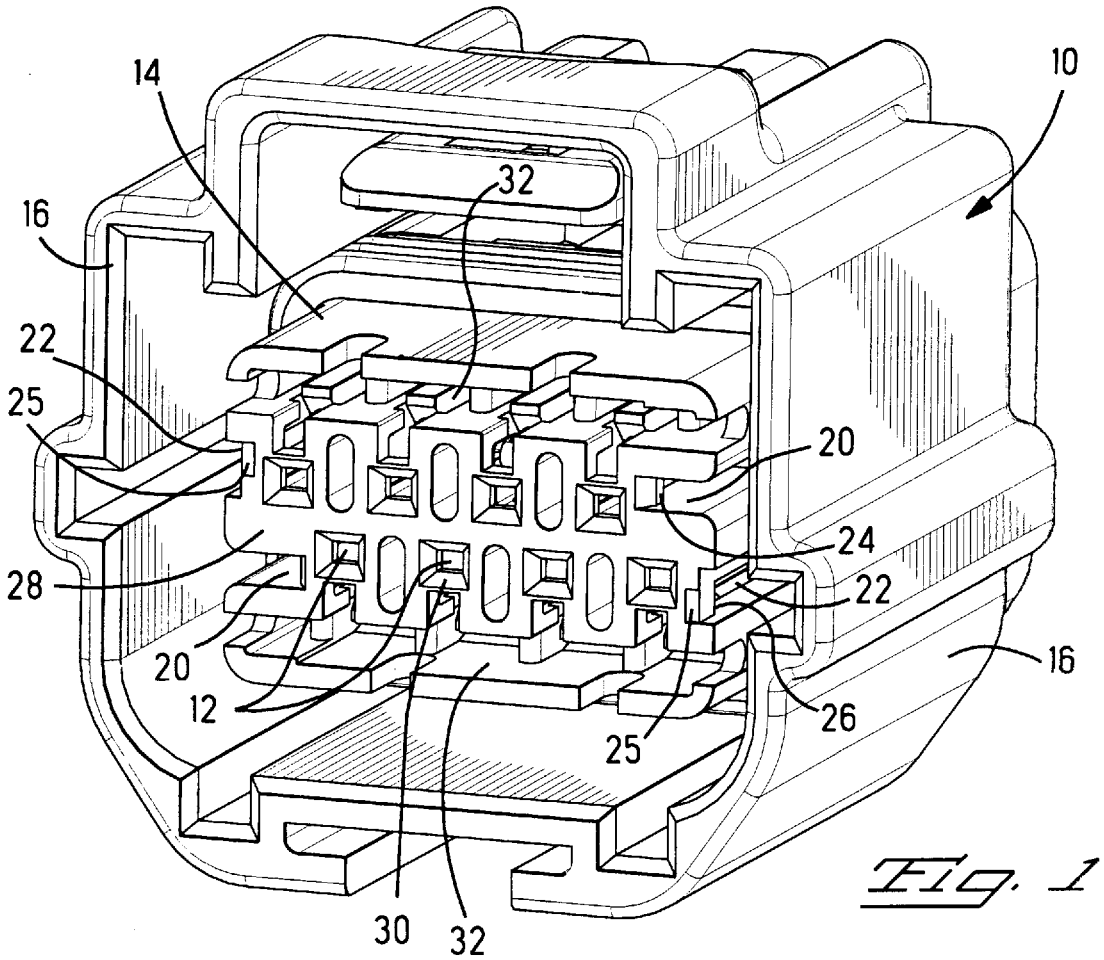
FIG. 1 is an isometric view of the plug connector of the present invention.

FIG. 1 shows an isometric view of the plug connector 10 of the present invention. The plug connector 10 has a plurality of contact receiving passages 12 disposed within an inner member 14. Disposed around the inner member 14 is a shroud 16. Along the top surface of the shroud 16 is a latching member 18 for latching to a matable connector, not shown.

The inner member 14 has, along opposite side walls, two grooves 20 to be used for pre-latching, as will be explained hereinafter. Along the side walls, there are also two grooves 22 for final latching. Each of the grooves 20, 22 also include latching surfaces 24, 26 which are directed towards the back of the plug connector 10, groove 22 has latching surface 25 directed forwardly.

The inner member 14 includes a front, mating surface 28. Disposed along the mating surface 28, at the entrance to each of the contact receiving passages 12, are lead-in surfaces 30. The lead-in surfaces 30 are chamfered inwardly to provide a surface for leading in the mating contacts, not shown. The lead-in surfaces provide a guide for the mating contacts to provide a smooth insertion of the mating connector. Along the top and the bottom of the inner member 14 are channels 32 which will receive the secondary locking member 40, as described later.

Figure 2:
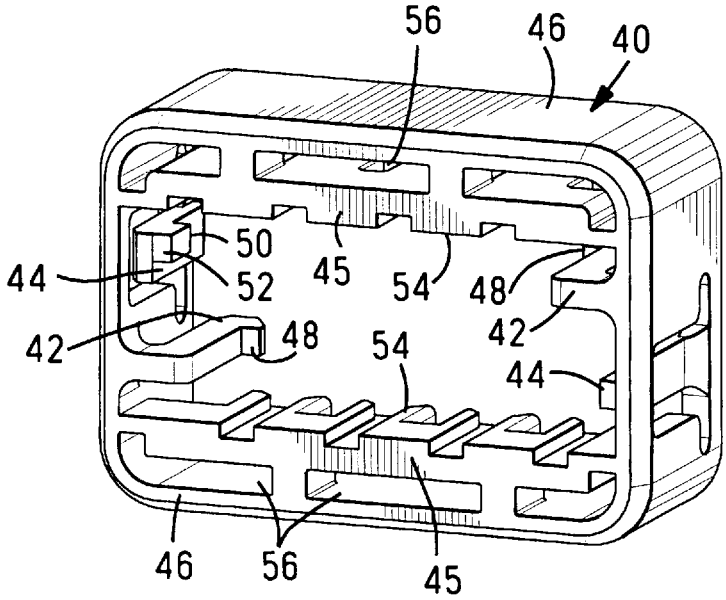
FIG. 2 is an isometric view of the secondary lock of the present invention.

FIG. 2 shows an isometric view of the secondary locking member 40. The secondary locking member 40 is typically made from a dielectric material. On opposite sides of the secondary locking member 40 are pre-latches 42 and final latches 44. The latches 42, 44 extend inwardly from a frame 46 which comprises the periphery of the secondary locking member 40. The pre-latches 42 are resilient arms and having latching surfaces 48 which are directed toward the front of the secondary locking member 40. The final latches 44 are resilient arms that directed forwardly and have protrusions that have a first latching surface 50 and a second latching surface 52. Along the top and the bottom, on the inner side of the frame 46, are cross arms 45 having secondary locking surfaces 54 thereon. Also along the top and the bottom of the frame 46 are slots 56 which will engage with the inner body 14.

Figure 3:
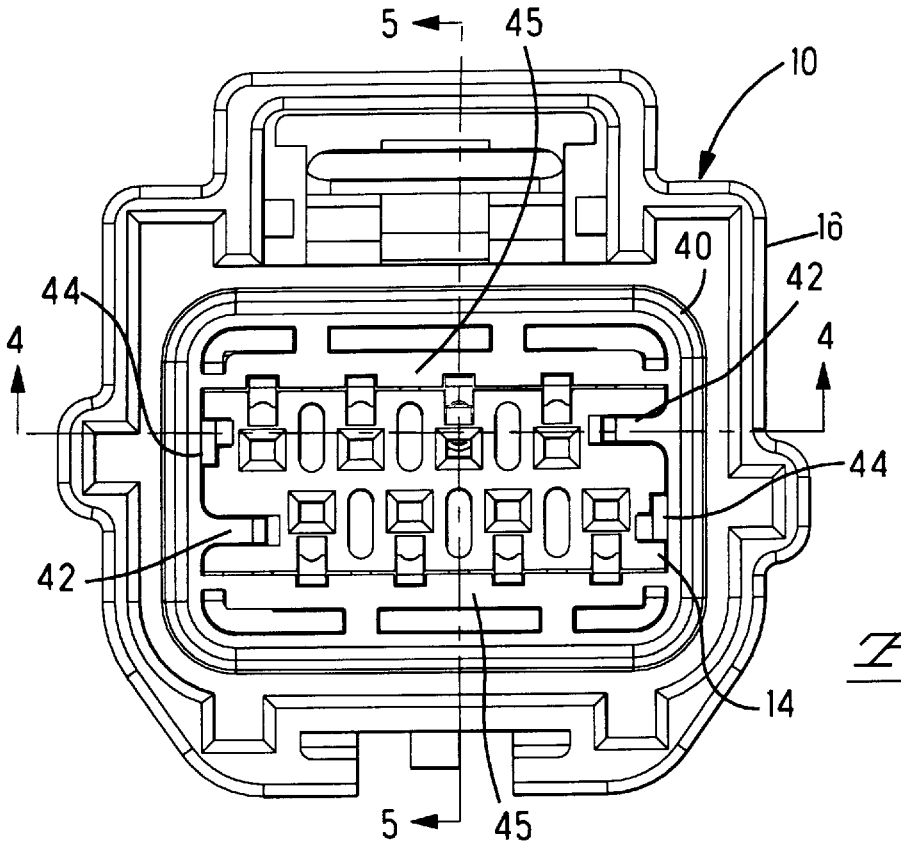
FIG. 3 is a front view of the plug connector with the secondary lock.
Figure 4:
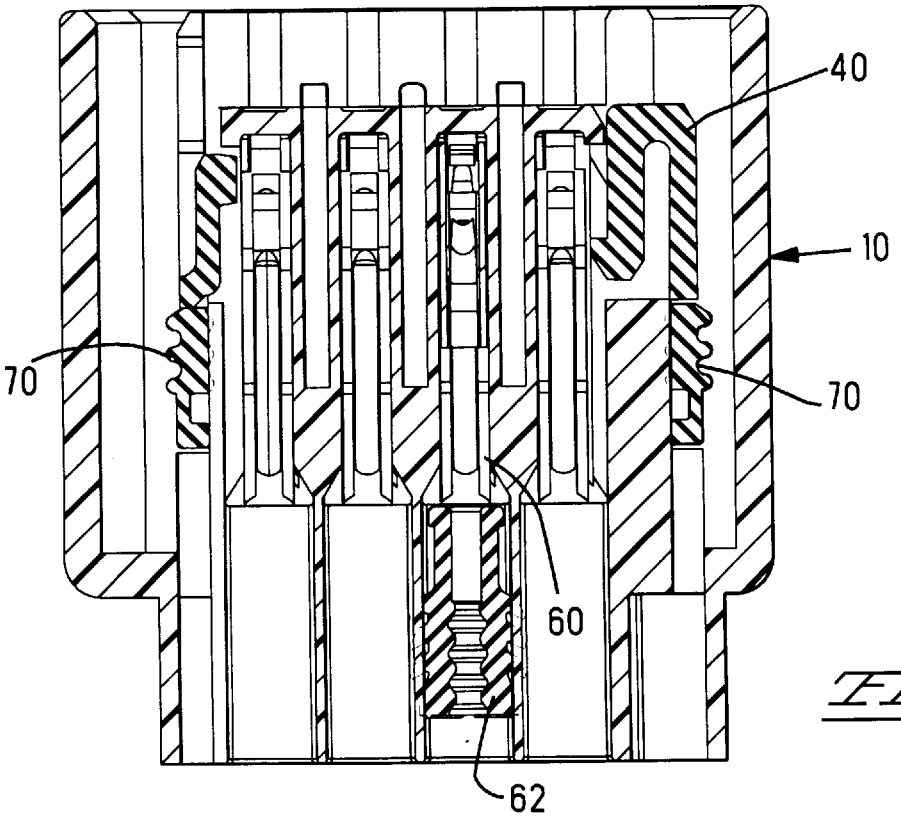
FIG. 4 is a cross sectional view taken along the line 4—4 in FIG. 3.

FIG. 3 shows a front view of the plug connector 10 with the secondary locking member 40 secured along the mating face 28. The pre-latches 42 are aligned with the pre-latching grooves 20 and the final latches 44 are aligned with the final latching grooves 22. The cross-arms 45 are aligned with channels 32 so that the cross-arms can be received within the channels 32.

Figure 5:
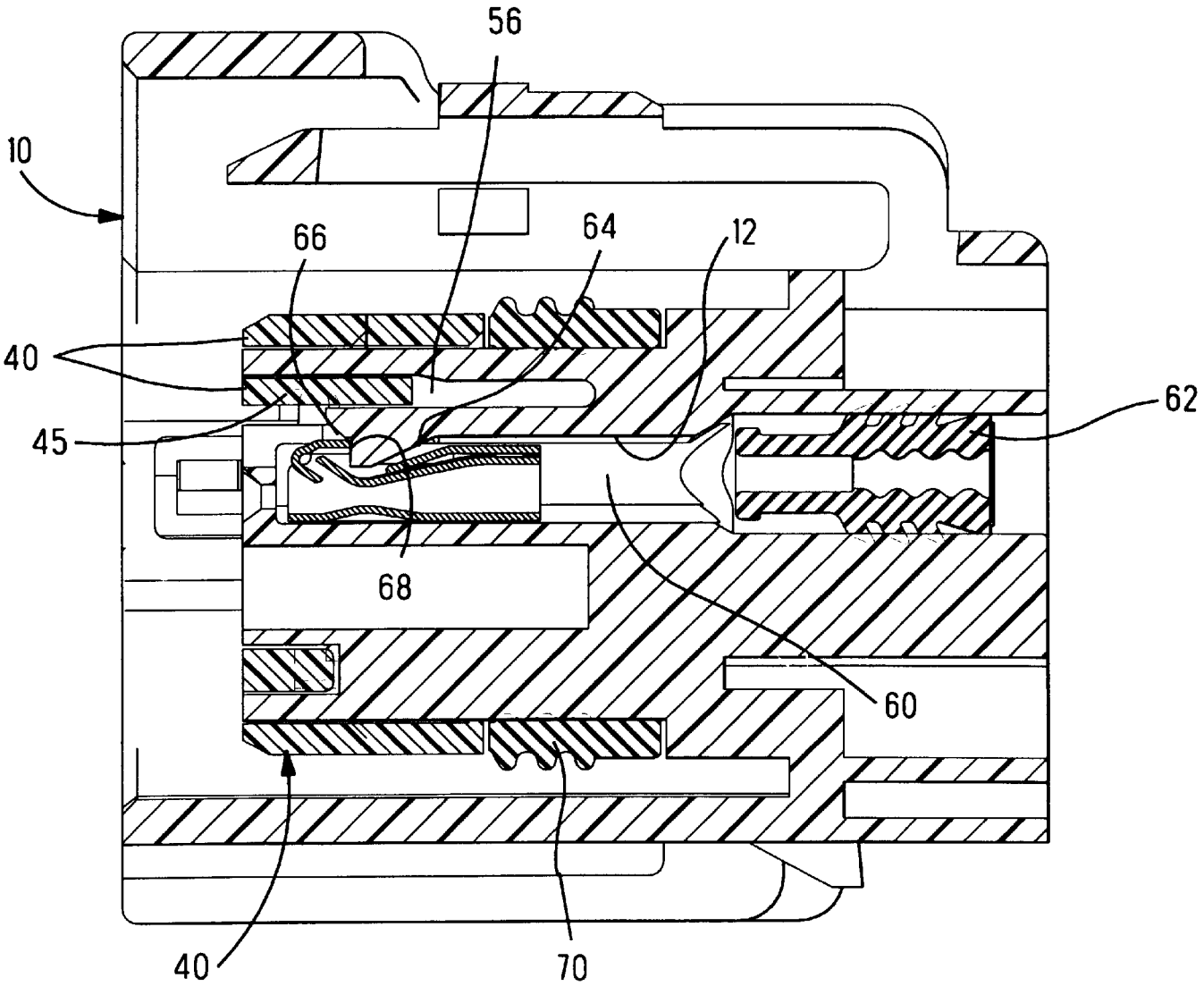
FIG. 5 is a cross sectional view taken along the line 5—5 in FIG. 3.

FIG. 5 shows a cross-sectional view of the plug connector 10 with the secondary locking member installed in the final latched position. In this view, it can be seen that contacts 60 are received within the contact receiving passages 12. The contacts 60 typically are connected to a wire, not shown, and a seal 62 is received over the rear of the contact 60 to seal the rear portion of the contact receiving passage 12.

Along the interior of the contact receiving passages 12 are primary latching arms 64 having latching surfaces 66. The contacts 60 have latching shoulders 68. When the contacts 60 are inserted into the passages 12, the primary latching arms 64 will deflect into channels 32 and when the contacts are correctly positioned, the primary latching arms 64 will resile back to their initial position thereby locking the contacts into place within the passages 12. FIG. 5 shows the secondary locking member 40 in the final latching position which prevents the latching arms 64 from deflecting into the channels 32 thereby secondarily locking the contacts in place within the passages 12.

FIG. 5 shows a second seal 70 which is received about the inner member 14. The second seal 70 will engage and seal against the mating connector, not shown.

Figure 6:
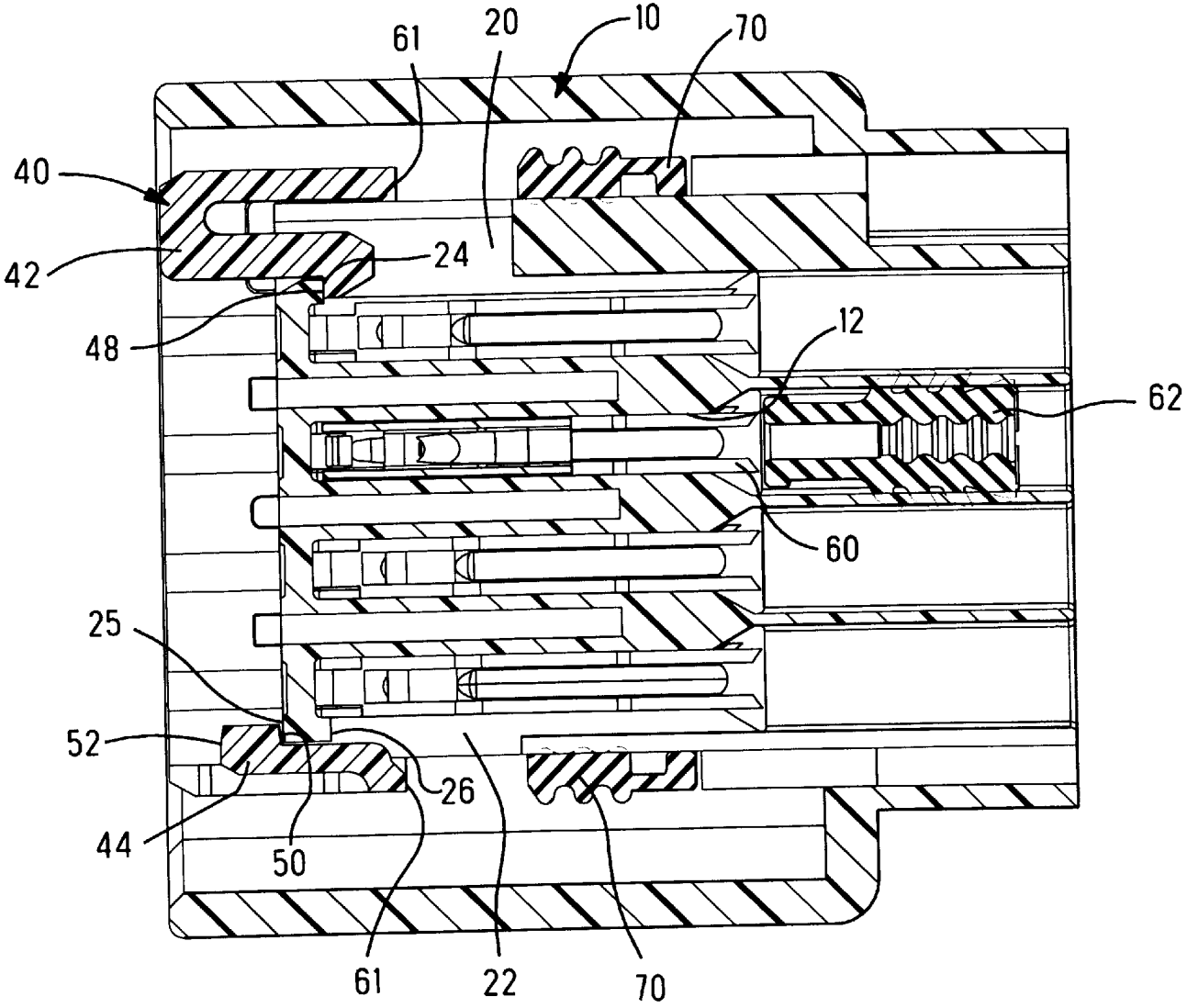
FIG. 6 is a cross sectional view showing the secondary lock in the pre-latch position.
Figure 7:
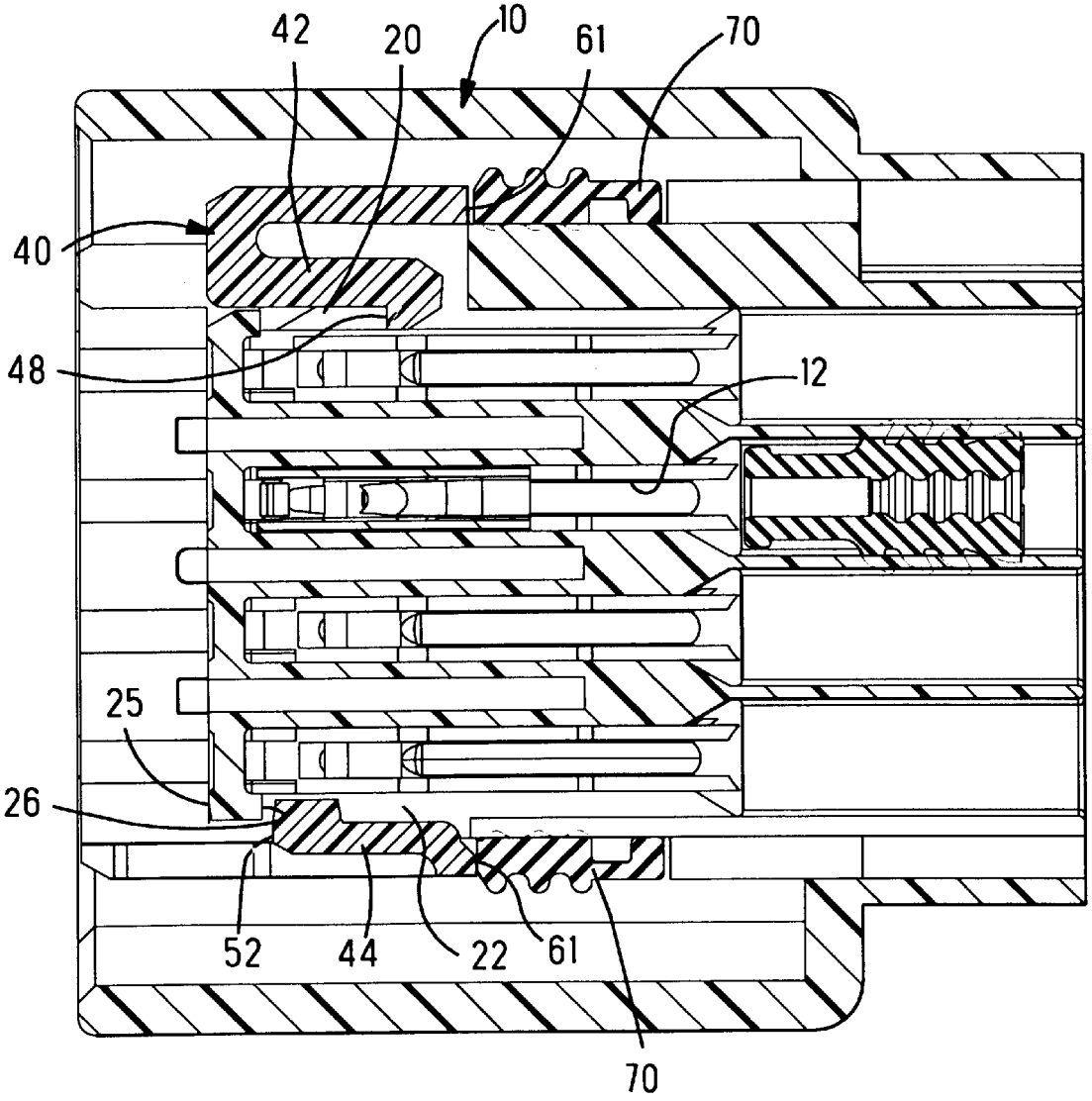
FIG. 7 is a cross sectional view showing the secondary lock in the final position.

FIG. 6 shows the secondary locking member 40 in the pre-latched position. In this position, the cross-arms 45 are not received within the channels 32 so that the contacts 60 can be loaded into the connector when the secondary locking member 40 is in this position. The latching surfaces 48 on the pre-latches 42 are received within the grooves 20 and the latching surfaces 48 engage the latching surfaces 24. Further, the first latching surfaces 50 on the final latches 44 are received against latching surface 25 proximate to groove 22. When the contacts 60 are fully loaded in the connector and the latching arms 64 are all in their initial position with the contacts latched in the passages 12, the secondary locking member can be pushed further along the inner member 14, to the right as shown in FIG. 7, into the final latched position. In this position, the final latches 44 have snapped past the latching surface 25 proximate to the groove 22 and into the groove 22 so that the latching surfaces 26 engage the second latching surfaces 52 on the final latches 44. The cross-arms 45 are received within the channels 32 thereby secondarily locking the contacts 60 into their correct position. The back surfaces 61 of the secondary locking member 40 abut against the second seal 70 thereby securing the secondary locking member 40 between the mating surface 28 and the second seal 70.

A further feature of the connector of the present invention is that if any of the contacts 60 are not in their proper position within the passages 12, the latching arms 64 will be deflected into channel 32. The deflected latching arm 64 will prevent the secondary locking member 40 from being advanced to its final position because the cross-arm 45 will engage the deflected latching arm 64. This works as a good indicator to the operator that the contacts are not properly seated with the connector.

Typical secondary locking members are received along the front surface of the connector and provide the mating surface. Therefore, the lead-in surfaces are disposed along the secondary locking members. Because the lead-in surfaces are disposed on the plug connector in the present invention, the lead-in surfaces can be made more precisely. The lead-in surfaces are molded at the same time as the passages and therefore can be more precisely aligned with the passages.

An additional advantage of the present invention is that the secondary locking member 40 secures the second seal 70 onto the plug connector.

The electrical connector of the present invention and many of its attendant advantages will be understood from the foregoing description. It is apparent that various changes may be made in the form, construction, and arrangement of parts thereof without departing from the spirit and scope of the invention, or sacrificing all of its material advantages.

What is claimed is:

1. An electrical connector, comprising:

a body fronted by a mating face, the body having contact receiving passages therein, the contact receiving passages having contact latching arms which are deflectable into channels when contacts are improperly seated within the contact receiving passages, the contact latching arms resiling upon correct seating of the contacts, the channels being disposed on opposing external walls of the body, the opposing external walls being connected by opposing sidewalls to define a periphery of the body; and a secondary locking member for engagement with the body about the mating face, the secondary locking member comprised of top and bottom cross arms connected by opposing side arms, wherein the secondary locking member is received around the periphery of the body such that the cross arms are received within the channels when the secondary locking member is engaged with the body, thereby preventing deflection of the contact latching arms to retain the contacts when the contacts are properly seated.

2. An electrical connector, comprising:

a body having an inner member fronted by a mating face, the inner member having contact receiving passages having contact latching arms which are deflectable into channels when contacts are improperly seated within the contact receiving passages, the contact latching arms resiling upon correct seating of the contacts, a seal being received around the inner member, the channels being disposed on opposing external walls of the inner member, the opposing external walls being connected by opposing sidewalls to define a periphery of the inner member; and a secondary locking member for engagement with the inner member about the mating face, the secondary locking member having top and bottom cross arms connected by opposing side arms, wherein the secondary locking member is received around the periphery of the inner member such that the cross arms are received within the channels when the secondary locking member is engaged with the inner member, thereby preventing deflection of the contact latching arms to retain the contacts when the contacts are properly seated, the secondary locking member engaging and securing the seal when the secondary locking member is engaged with the inner member.

3. The electrical connector of claim 1, wherein a contact seal resides within each contact receiving passage and is positioned to receive a contact therethrough.

4. The electrical connector of claim 2, wherein a contact seal resides within each contact receiving passage and is positioned to receive a contact therethrough.

5. The electrical connector of claim 1, wherein the body has an inner member, and the secondary locking member has latching arms positioned to be received within latching grooves alongside the inner member.

6. The electrical connector of claim 1, wherein the secondary locking member has a first latched position wherein the contacts are received within the contact receiving passages, and a second latched position wherein the cross arms are received within the channels thereby preventing deflection of the contact latching arms and retaining contacts within the contact receiving passages.

7. The electrical connector of claim 2, wherein the seal is annularly ribbed.

8. The electrical connector of claim 1, wherein the secondary locking member is constructed of dielectric material.

9. The electrical connector of claim 2, wherein the secondary locking member is constructed of dielectric material.

10. The electrical connector of claim 1, wherein the contact receiving passages have lead-in passages disposed at one end of the contact receiving passages along the mating face.

11. The electrical connector of claim 2, wherein the contact receiving passages have lead-in passages disposed at one end of the contact receiving passages along the mating face.

12. The electrical connector of claim 10, wherein the lead-in passages have surfaces which are chamfered inwardly.

13. The electrical connector of claim 11, wherein the lead-in passages have surfaces which are chamfered inwardly.

14. The electrical connector of claim 1, wherein the body has a shroud disposed about its perimeter.

15. The electrical connector of claim 14, wherein the shroud has a latching member for latching with a matable connector.

16. The electrical connector of claim 2, wherein the body has a shroud disposed about the inner member.

17. The electrical connector of claim 16, wherein the shroud has a latching member for latching with a matable connector.

18. The electrical connector of claim 2, wherein the secondary locking member has a first set of latches and a second set of latches, and wherein the inner member has a first set of grooves and a second set of grooves, said first set of grooves being disposed to receive said first set of latches thereby defining a pre-latched position in which the contacts may be received within the contact receiving passages, said second set of grooves being disposed to receive said second set of latches thereby defining a final latched position in which the contacts are retained within the contact receiving passages.

* * * * *